US006381904B1

(12) United States Patent
Tedescucci

(10) Patent No.: US 6,381,904 B1
(45) Date of Patent: May 7, 2002

(54) TRACK MOUNTED BATH DOORS WITH CLIP ANTI-DERAILER

(75) Inventor: Joseph F. Tedescucci, Martin, TN (US)

(73) Assignee: Kohler Co., Kohler, WI (US)

( * ) Notice: Subject to any disclaimer, the term of this patent is extended or adjusted under 35 U.S.C. 154(b) by 16 days.

(21) Appl. No.: 09/604,154

(22) Filed: Jun. 27, 2000

(51) Int. Cl.[7] ..... E05D 13/00; E05D 15/06

(52) U.S. Cl. ..... 49/409; 49/413; 16/87.4 R; 16/87.6 R; 16/94 R

(58) Field of Search ..... 49/375, 409, 410, 49/413; 52/716.5, 207, 204.51; 16/87 R, 87.2, 87.4 R, 87.6 R, 94 R; 4/557; 160/196.1, 199, 206

(56) References Cited

U.S. PATENT DOCUMENTS

| | | | | |
|---|---|---|---|---|
| 1,575,083 A | | 3/1926 | Tracy | |
| 2,858,408 A | * | 10/1958 | Barroero | 49/70 |
| 2,929,115 A | | 3/1960 | Beckstrom | |
| 3,309,816 A | | 3/1967 | Malone, Jr. | |
| 3,473,266 A | | 10/1969 | Miller | |
| 3,925,933 A | * | 12/1975 | Reuter | 49/409 |
| 4,014,377 A | * | 3/1977 | Kochanowski | 160/186 |
| 4,178,718 A | * | 12/1979 | Laby | 49/411 |
| 4,574,526 A | * | 3/1986 | Lindquist | 49/411 |
| 4,750,781 A | * | 6/1988 | Betteridge | 296/214 |
| 4,887,394 A | * | 12/1989 | Marlowe | 49/409 |
| 4,998,304 A | * | 3/1991 | Sauter et al. | 4/559 |
| 5,079,872 A | * | 1/1992 | Short | 49/409 |
| 5,598,666 A | | 2/1997 | Kurth | |
| 6,119,403 A | * | 9/2000 | Klippert et al. | 49/375 |
| 6,148,451 A | * | 11/2000 | DeBraal et al. | 4/607 |

FOREIGN PATENT DOCUMENTS

| | | |
|---|---|---|
| DD | 291114 | 6/1991 |

* cited by examiner

*Primary Examiner*—Gregory J. Strimbu
(74) *Attorney, Agent, or Firm*—Quarles & Brady

(57) ABSTRACT

A door system for an enclosure such as a shower enclosure, including sliding doors suspended from hanging brackets which are attached to rails mounted to an opening of the enclosure. The hanging brackets include rollers which roll along the rails enabling the doors to slide with respect to the rails. The hanging brackets include anti-derailer clips snap fitted onto the brackets after the doors are hung from the rails to prevent the doors from being removed from the rails . The clips each have flexible catches at their top and bottom, as well as projections on a side to align their position with respect to the brackets.

7 Claims, 2 Drawing Sheets

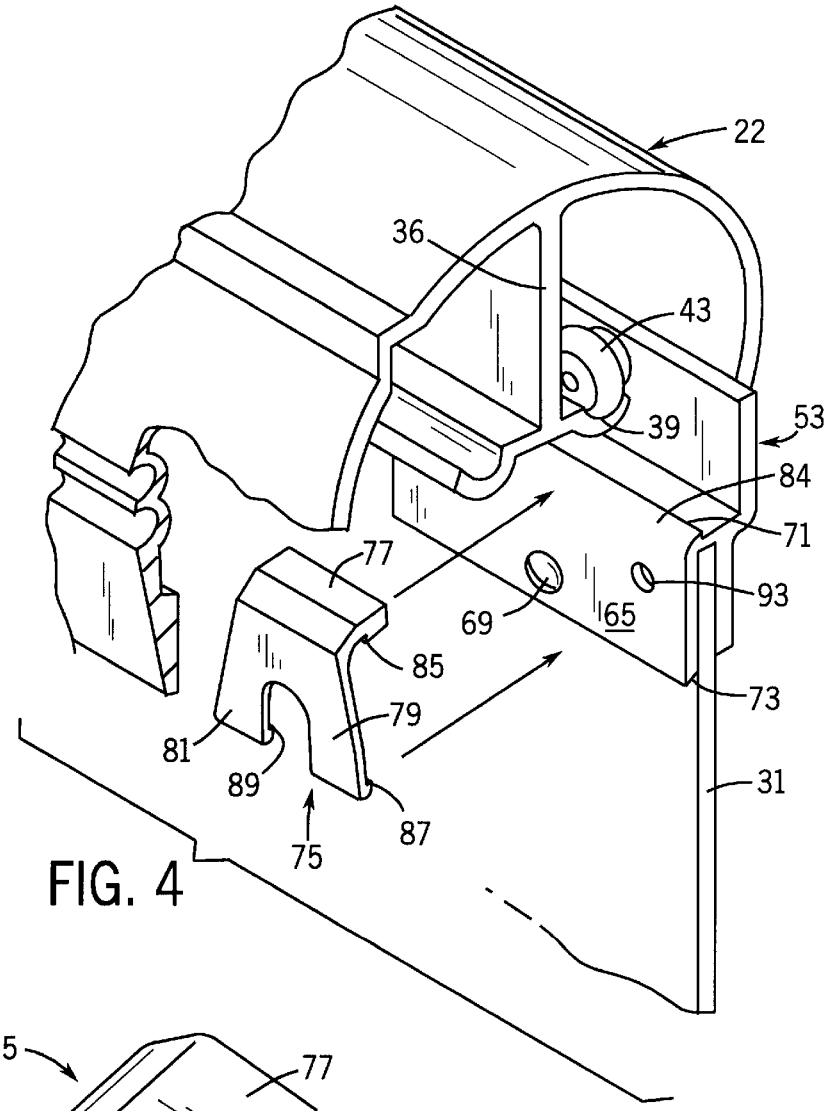
FIG. 4
FIG. 3
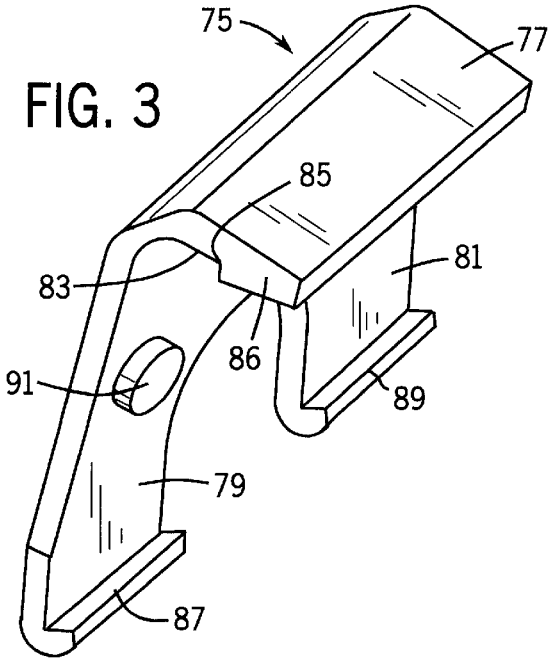

TRACK MOUNTED BATH DOORS WITH CLIP ANTI-DERAILER

CROSS-REFERENCE TO RELATED APPLICATIONS

Not Applicable

STATEMENT REGARDING FEDERALLY SPONSORED RESEARCH/DEVELOPMENT

Not Applicable

BACKGROUND OF THE INVENTION

The present invention relates to sliding doors of the type commonly used as part of a bathing enclosure. More particularly it relates to doors that are suspended from and slidable along an overhead track.

Bathing enclosures often have an opening that is closed with a pair of sliding doors. There is a lower track mounted on the rim of the tub or shower pan and another track mounted in a "header" near the top of the enclosure. Doors typically slide in separate, parallel tracks within the header and are able to slide past each other. A pair of rollers is mounted on each door that ride in a groove in an overhead track. The rollers enable the door to glide in a horizontal direction along the header.

Typically the header is installed into the opening before the doors are hung on the tracks. Consequently, there is no access to the tracks located in the header from their sides. Rather, the doors must be hung on the tracks by tilting and then lifting the doors up until the rollers fit over a rail, and then by tilting the doors back and setting them down with the rollers on grooves of the rails.

This requires a relatively large gap between the roller and the top of the door panel. Absent other structures, the rollers may be inadvertently derailed due to this gap. For example, if the door is shut with too much force it may rebound upward instead of just straight back along the track. A structure such as that shown in U.S. Pat. No. 2,929,115 is an example of an assembly of this type that is susceptible to such a problem. The disclosure of this patent and of all other publications referred to herein are incorporated by reference as if fully set forth.

There were some attempts to avoid the derailment problem. For example, U.S. Pat. No. 5,598,666 disclosed the use of a threaded fastener for reducing the size of the gap after the doors were installed. Although this was a considerable improvement over the prior art, the fasteners were somewhat difficult to access, and a screwdriver was needed to rotate them.

German exclusion patent DD 291,114 disclosed the use of a push-on locking member to help take up some of the gap. However, the connection between that locking member and the bracket was not a sufficiently secure one.

Thus, it can be seen that a need still exists for improved systems for preventing derailing of such doors.

SUMMARY OF THE INVENTION

In one aspect the invention provides a door system for an enclosure which has an opening. The door system has a track extending along an upper portion of the opening that has a rail with an upper track surface and a lower surface. There is also a door, at least one hanging bracket attached to an upper portion of the door, and a roller attached to the hanging bracket such that the roller can ride on the track surface of the rail while the door is suspended from the roller below the rail.

In accordance with the present invention there is also a clip attachable to the hanging bracket by a snap-fit connection such that at least a portion of the clip is positioned under the rail lower surface yet above the height of the top of the door. When the clip is attached to the hanging bracket it can restrict removal of the roller from the rail.

The clip can include a top lip engageable with an upwardly facing catch surface of the bracket and a bottom lip engageable with a downwardly facing catch surface of the bracket. The bottom lip is preferably a foot of a flexible leg which can deflect relative to the top lip as the clip is being snapped onto the hanging bracket.

There is also preferably a recess and projection connection between the bracket and clip along essentially vertical surfaces of both. The recess and projection connection aligns the clip along the bracket and also serves to restrict it from sliding sideways relative to the bracket once the clip is snapped on the bracket. The projection is preferably a cylindrical projection extendable from the clip towards the bracket and the recess is preferably a circular groove in the hanging bracket suitable to receive the projection.

The hanging bracket is preferably made from extruded aluminum and the clip is preferably made from a flexible plastic. Other materials may be suitable as well, depending on the environment in which the system is used.

In bypass door type systems (such as would be used desirable to control access to a shower enclosure), there can be two such doors, each hanging from a separate such rail by at least two such rollers attached to at least two such hanging brackets secured by two such clips.

An advantage of the present invention is to provide a door assembly in which the doors are resistant to derailing. Another advantage is to provide such an assembly in which the anti-derailing feature can be activated and deactivated quickly, without special tools.

These and still other advantages of the present invention will be apparent from the description below.

BRIEF DESCRIPTION OF THE DRAWINGS

FIG. 3 is a rear perspective view of an anti-derailer clip for use in the door system of FIG. 1; and FIG. 4 is a rear perspective view, partially cut-away, and partially disassembled, of the door system of FIG. 1.

DETAILED DESCRIPTION OF THE PREFERRED EMBODIMENTS

Figure 1:
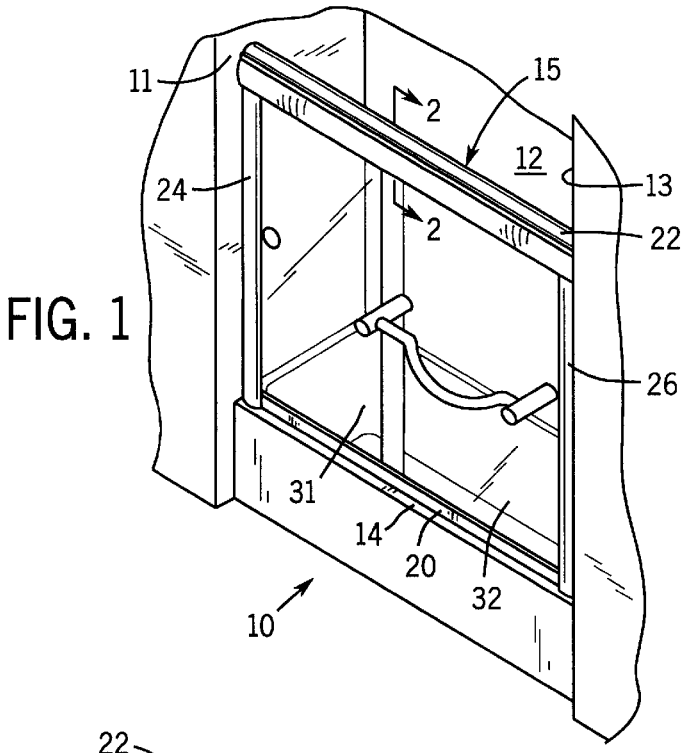
FIG. 1 is a perspective view of a bathing enclosure which incorporates the anti-derailing system of the present invention.

As shown in FIG. 1 a bathtub 10 is located in a recess formed by walls 11, 12 and 13. The bathtub 10 can include a front rim 14 extending between walls 11 and 13. Although the present door system is being described in the context of a bathtub with shower region above the tub basin, it also can be applied to shower stalls and other building enclosures.

The tub recess is closed by a door system 15 which includes a lower track 20 mounted on the front tub rim 14 and an overhead track 22 which extends directly over the lower track between walls 11 and 13. Separate wall jambs 24 and 26 extend vertically along each side wall 11 or 13, respectively, between the two tracks 20 and 22. The tracks 20 and 22 and wall jambs 24 and 26 define an opening of the tub enclosure.

Two glass-panel doors 31 and 32 are suspended from the overhead track 22 in the enclosure opening and extend downward to the front rim 14 of the tub 10 into the lower track 20. The inner door 31 and the outer door 32 can slide in either direction past one another along the two tracks 20 and 22 to create a passageway adjacent either side wall 11 or 13 through which a bather enters and exits the shower enclosure 10.

Figure 2:
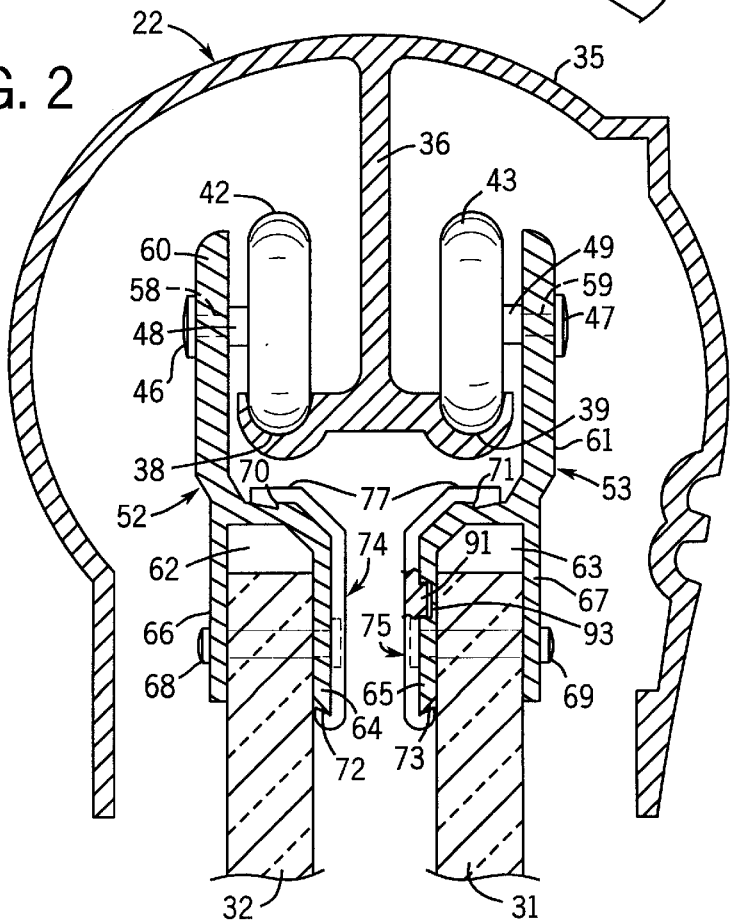
FIG. 2. is a cross-sectional view taken along line 2—2 in FIG. 1.

Referring next to FIGS. 2 and 4, the overhead track 22 is formed by an elongated channel/header member 35 with an inverted U-shaped cross section and having a central longitudinal support 36 within the opening of the header 35. The support 36 has two parallel longitudinal rails 38 and 39, respectively, within which rollers 42 and 43 ride. Roller 42 is mounted on an axle 48 attached to a fastener 46 that extends through a hole 58 in an upper wall 60 of a hanger mounting bracket 52 fixed to the door 32. The other illustrated roller 43 is mounted on axle 49 that is connected by a fastener 47 that extends through a hole 59 in an upper end 61 of a mounting bracket 53 attached to the inner door 31. Two roller and bracket assemblies of this design are spaced apart along the top edge of each door 31 and 32. The rollers for the door 31 ride within rail 39, while the outer door rollers ride within rail 38.

The mounting brackets 52 and 53 define respective inverted U-shaped channels 62 and 63 the openings of which receive the top of the doors 32 and 31, respectively. The channels 62 and 63 extend from the upper walls 60 and 61 and have respective front sides 64 and 65 and back sides 66 and 67. Door fasteners 68 and 69 extend through aligned holes in the front 64 and 65 and back 66 and 67 sides of the mounting brackets 52 and 53, respectively, to secure the two doors 32 and 31. In this arrangement, the doors 31 and 32 hang plumb directly below their respective rollers 43 and 42. The front sides 64 and 65 define top 70 and 71 and bottom 72 and 73 catch surfaces to which anti-derailer clips 74 and 75 are attached.

The anti-derailer clips 74 and 75 are preferably an inverted generally L-end view shaped semi-rigid resin structure. FIG. 3 shows anti-derailer clip 75 which has a top 77 generally perpendicular to two downwardly extending legs 79 and 81. The top 77 has a bottom surface 83 defining a lengthwise lip 85 and the legs 79 and 81 have upwardly lipped feet 87 and 89, respectively. The anti-derailer clip 75 also has a cylindrical alignment projection 91 at an inside surface located and sized to fit within an opening 93 (see FIG. 4) in the front side 65 of the mounting bracket 53.

Referring to FIG. 4, when the door 31, for example, is being assembled onto the overhead track 22, the anti-derailer clip 75 is not yet attached to the mounting bracket 53. This leaves a sufficiently large gap between the bottom of the rail 39 and the top of the bracket 53 to fit the roller 43 up and around the rail 39.

Once the roller 43 is on rail 39 the gap is no longer helpful and, in fact, allows the door 31 to too easily derail. Thus, the anti-derailer clip 75 is snapped onto the mounting bracket 53 so that the projection 91 fits within the retainer opening 93 and the lip 85 engages the catch surface 71 and the feet 87 and 89 engage the catch surface 73.

In this regard, preferably there is a slight depression or slope along region 84 of the top panel of the bracket to better restrain lip portion 86 when it is placed thereon. Also, feet 87 and 89 are sized and angled so as to be able to snap catch under lower bracket edges 72 and 73. Further, the anti-derailer clip 75 is prevented from sliding along the mounting bracket 53 by the engagement of the projection 91 and opening 93.

As shown in FIG. 2 the anti-derailer clip 75 reduces the gap between the top of the door and the bottom of the rail such that the door 31 cannot be removed from the track 22 without removing the anti-derailer clip 75. If door 31 is lifted or tilted, the top 77 of the anti-derailer clip 75 will contact or strike the bottom of the rail 39 before the roller 43 is brought over the rail 39. However, the reduced gap still provides sufficient spacing so that the top 77 of the anti-derailer clip 75 does not scrape against the rail 39 during normal operation. The anti-derailer clip 75 can be unclipped using a knife blade or similar tool. However, it is very secure during normal use.

Although FIG. 4 illustrates one such bracket assembly positioned against one end of one door, it should be appreciated that typically at least two such assemblies will be on each door, preferably with a bracket assembly located adjacent each opposite lateral end of the door. To ease assembly, the doors can be positioned as shown in FIG. 1 when the clips are being placed thereon, rather than overlapped next to each other. This provides greater access to the bracket regions.

Various other changes may be made to the preferred embodiment without departing from the spirit or scope of the invention. For example, other forms of alignment and stable positioning between the clip and bracket can be used. Accordingly, reference should be made to the following claims to assess the full scope of the invention.

The present invention provides sliding door structures for use in closing off bathing enclosures or the like. These structures are resistant to derailing, with the derailing feature being connected and unconnected without extra tools.

What is claimed is:

1. A door system for an enclosure which has an opening, the door system comprising:

a track suitable for mounting along an upper portion of the opening and having a rail with an upper track surface and a lower surface;

a door;

at least one hanging bracket attached to an upper portion of the door;

at least one roller attached to the hanging bracket such that the roller can ride on the upper track surface of the rail while the door is suspended from the roller below the rail; and a clip being adapted to be attached to the hanging bracket by being snap fitted onto the hanging bracket such that at least a portion of the clip is positioned between the rail lower surface and a top of the door and at least a portion of the clip is positioned below said portion of the clip positioned between the rail lower surface and the top of the door;

whereby when the clip is attached to the hanging bracket, the clip restricts upward movement of the roller with respect to the rail by occupying space between the rail and the hanging bracket.

2. The door system of claim 1, wherein the clip includes a top lip engageable with an upwardly facing catch surface of the bracket and a bottom lip engageable with a downwardly facing catch surface of the bracket.

3. The door system of claim 2, wherein the bottom lip is a foot of a flexible leg which can deflect relative to the top lip as the clip is being snapped on the hanging bracket.

4. The door system of claim 1, wherein there is a recess and projection connection between the bracket and the clip along essentially vertical surfaces of both, whereby the connection serves to align the clip with the bracket and restrict the clip from sliding relative to the bracket.

5. The door system of claim 1, wherein said at least one roller comprises two rollers and said at least one hanging bracket comprises two hanging brackets and said door system further comprises an additional door and an additional rail, the additional door hanging the additional rail.

6. The door system of claim 1, wherein the hanging bracket is made from extruded aluminum and the clip is made from a flexible plastic.

7. A door system for an enclosure which has an opening, the door system comprising:

a track suitable for mounting along an upper portion of the opening and having a rail with an upper track surface and a lower surface;

a door;

at least one hanging bracket attached to an upper portion of the door;

a roller attached to the hanging bracket such that the roller can ride on the upper track surface of the rail while the door is suspended from the roller below the rail; and a clip being adapted to be attached to the hanging bracket by being snap fitted onto the hanging bracket such that at least a portion of the clip is positioned between the rail lower surface and a top of the door and at least a portion of the clip is positioned below said portion of the clip positioned between the rail lower surface and the top of the door;

whereby when the clip is attached to the hanging bracket, the clip restricts upward movement of the roller with respect to the rail by occupying space between the rail and the hanging bracket;

wherein there is a recess and projection connection between the bracket and the clip along essentially vertical surfaces of both, whereby the connection serves to align the clip with the bracket and restrict the clip from sliding relative to the bracket;

wherein the recess and projection connection is a cylindrical projection extending from the clip and a circular groove in the hanging bracket suitable to receive the projection.

* * * * *

UNITED STATES PATENT AND TRADEMARK OFFICE

CERTIFICATE OF CORRECTION

PATENT NO. : 6,381,904 B1
DATED : May 7, 2002
INVENTOR(S) : Joseph F. Tedescucci It is certified that error appears in the above-identified patent and that said Letters Patent is hereby corrected as shown below:

Column 5,
Line 5, replace "hanging the additional" with -- hanging from the additional. --

Signed and Sealed this

Eighth Day of October, 2002

*Attest:*

*Attesting Officer*

JAMES E. ROGAN
*Director of the United States Patent and Trademark Office*